US005134798A

United States Patent [19]

Lee

[11] Patent Number: 5,134,798

[45] Date of Patent: Aug. 4, 1992

[54] TWO SIGHT MOUNT

[76] Inventor: Roberto R. Lee, 731 Fairmont Ave., Glendale, Calif. 91203

[21] Appl. No.: 660,295

[22] Filed: Feb. 22, 1991

[51] Int. Cl.[5] ..... F41G 1/393

[52] U.S. Cl. ..... 42/100; 42/101; 42/103; 33/261

[58] Field of Search ..... 42/101, 103, 100; 33/261, 245, 250, 234

[56] References Cited

PUBLICATIONS

S.W.A.T., "Mounting Platform", Aug. 1991 p. 15.

*Primary Examiner*—Michael J. Carone

[57] ABSTRACT

An elongated base bar comprising an auxiliary sight base bar having an upper surface, a forward end a rearward end, used for mounting two optical sights on a firearm, a telescope sight combined with a day/night sight or a laser sight. The rearward end being rigidly attached to the forward end of the elongated base bar, having an upper sight receiving portion, clamping guide on the upper sight receiving portion, a lower mounting portion, see-through center hole having an axis parallel to the longitudinal axis of the elongated base bar and located between the upper sight receiving portion and the lower mounting portion, a self-aligning v-guide and a threaded mounting hole on the lower mounting portion for mounting on a firearm. The upper surface on the forward end of the auxiliary sight base bar having a detachable clamping guide, is in line with and parallel to the elongated base bar and also spaced at a distance below the see-through center hole which when mounted with a day/night sight the day/night sight will be in line with and in between the standard front and rear sights of the rifle. The clamping guide on the upper surface of the auxiliary sight base bar is detachable, replaceable and self-aligning to accept widely used types of clamping rings.

2 Claims, 1 Drawing Sheet

SECTION 2-2

TWO SIGHT MOUNT

BACKGROUND

1. Field of Invention

This invention relates to a device for mounting two optical sights, used on rifle and more specifically to an elongated base bar sight mount device.

2. Description of Prior Art

A sight mount mounted with a telescope sight on a rifle is preferably used for aiming targets at longer range. At close-in range, using a telescope sight alone will often encounter aiming difficulties, having blurred cross-hairs and target image especially in limited light situations.

Since the day/night aiming device was developed, precise aiming and hitting targets more effectively have greatly increased especially with targets at closer range and with limited light shooting situations.

A prior art mount device is capable of mounting a single optical sight only. This is obviously highly disadvantageous, since changes in shooting distance and light conditions will often encounter aiming difficulties, making a single optical sight inadequate which tends a shooter to fire a guess shot, endangering innocent people or cause property damage.

In some prior art mount device. A laser sight is clamped directly on the barrel of the rifle close to the muzzle end. This is obviously highly disadvantageous since, when shooting from a ground prone position the laser sight is easily covered; damaged against hitting the ground or hard blocking objects; damaged from extreme high heat conducted from the barrel of the rifle which is fired continuously full automatic as in combat situations; and the bayonet lug is blocked which prevents the use of a fixed bayonet capability on assault type rifle.

In some other prior art device, a day/night sight can only be mounted on the top portion and above the through-hole of the mount. This is obviously highly disadvantageous since, the high position of the day/-night sight will delay the shooter in locating the red-dot, delaying sight to target alignment which will delay the first shot capability.

Moreover, none of the prior art mount devices permit mounting with two optical sights on a rifle allowing both sights to be functional at the same time for use at anytime alternatively.

OBJECTS AND ADVANTAGES

Accordingly, several objects and advantages of the present invention are:

(a) to provide a mount that can be produced from an aircraft type aluminum for its lighter weight, sufficient strength and easier manufacturing process.

(b) to provide a mount, for mounting two optical sights without doubling the increase in sights height and with maintaining the rifle length.

(c) to provide a mount, for mounting two optical sights which are both functional altogether, used for aiming and engaging targets at longer range, close combat range or in daytime and nighttime situations.

(d) to provide a mount, for mounting two optical sights close to the trigger finger which permits the use of a short remote cable on-off switch for the electronic laser sight.

(e) to provide a mount, for mounting two optical sights which maintains the use of fixed bayonet capability on assault type rifles.

(f) to provide a mount, for mounting two optical sights on a rifle which permits one of the optical sights, either a day or night sight, to be mounted in line with and in between the standard front and rear sights of the rifle which help achieve faster sight to target acquisition and faster first shot or multiple speed shot capabilities.

(g) to provide a mount, for mounting two optical sights on top of a rifle which are closely in the same level with the aiming eye and which permit the shooter to use either one of the optical sights instantly for aiming and engaging targets from a ground prone shooting position and allowing sights to be more free from obstructions from bushes or other covering objects.

(h) to provide a mount, for mounting two optical sights on a rifle which minimizes heat conduction from transferring towards the optical sights from heat generated from the rifle being fired full automatic, since the optical sights are separated from the rifle barrel.

(i) to provide a mount, for mounting two optical sights on top of the rifle which are well protected from direct impact against the ground and other hard objects in combat maneuver.

(j) to provide a mount, which permits shooter to select a single sight only or an optional sight for mounting with a singe optical sight on a firearm, (either a telescope, a day/night or a laser sight) and mounting a day/night sight or a laser sight either on the forward end or rearward end of the auxiliary sight base bar, for specific purpose.

Further objects and advantages are to provide a mount for mounting a telescope sight on the rearward end and mounting a day/night sight or a laser sight on the forward end of the auxiliary sight base bar, through the detachable clamping guide on the upper surface of the forward end of the elongated base bar, which permits removal and re-installation of the day/night or laser sight without altering the bullet point of impact or re-sighting by detaching the clamping guide only from the upper surface of the elongated base bar.

DRAWING FIGURE

REFERENCE NUMERAL IN DRAWING

Figure 1:
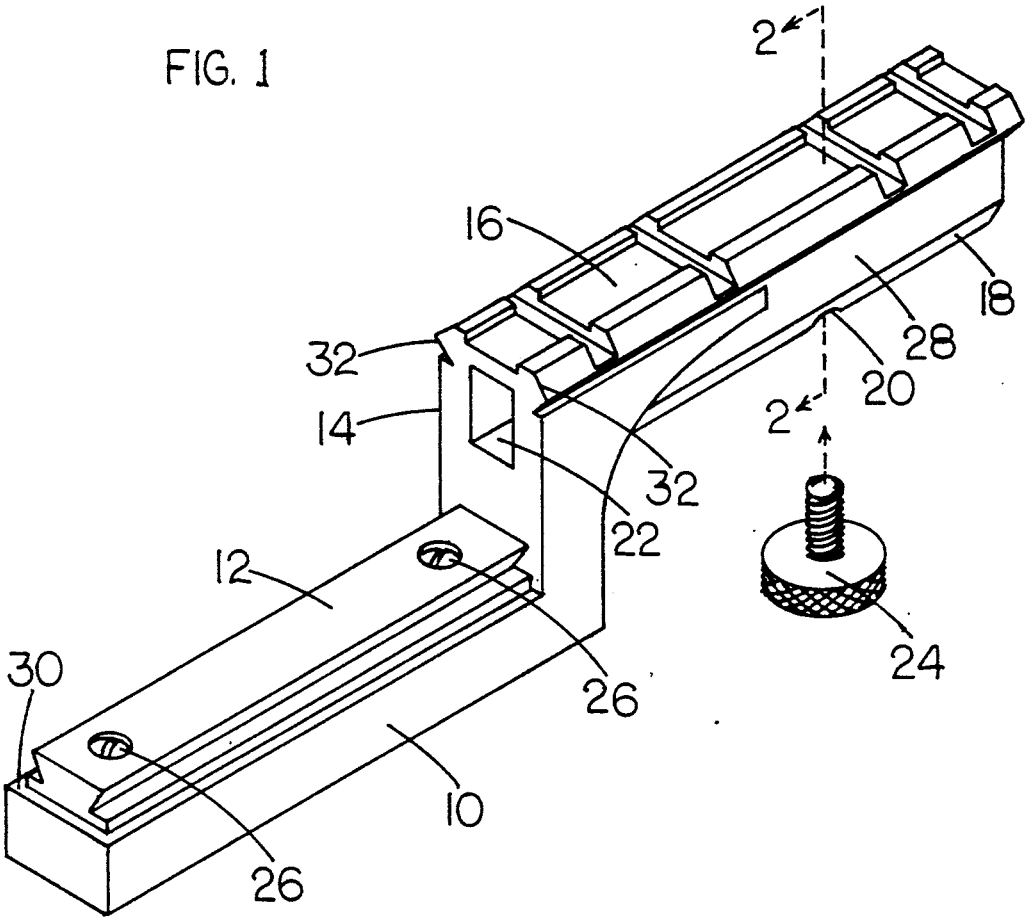
FIG. 1 shows an isometric view of the new auxiliary sight base bar mount.

10 forward end
12 detachable clamping guide
14 rearward end
16 upper sight receiving portion
18 self-aligning v-guide
20 mounting hole
22 see-through center hole
24 mounting screw
26 attaching screws
28 lower mounting portion
30 upper surface
32 clamping guide

DESCRIPTION—FIGS. 1 AND 2

Figure 2:
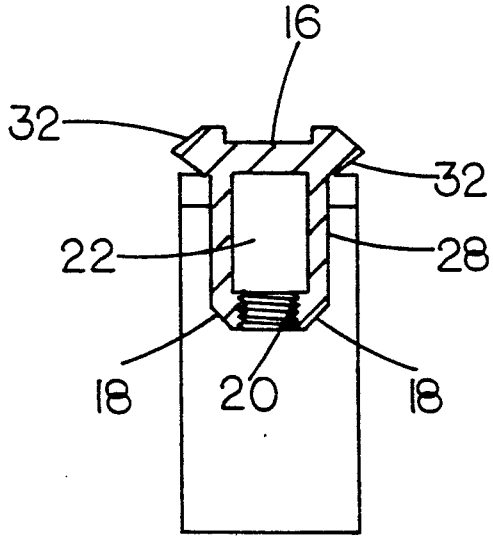
FIG. 2 shows section A—A, rear end view of the new auxiliary sight base bar mount, showing the upper sight receiving portion (16), self-alignment v-guide (18), see-through center hole (22), lower mounting portion (28) and the clamping guide (32).

A typical embodiment of the present invention is illustrated in FIGS. 1 and 2. The new auxiliary sight base bar mount comprising a rearward end 14 being rigidly attached to the forward end 10. The forward end 10 of the auxiliary sight base bar having an upper surface 30, a detachable clamping guide 12 and an attaching screws 26. The rearward end 14 of the auxiliary sight base bar having an upper sight receiving portion 16, clamping guide 32 on the upper sight receiving portion 16, lower mounting portion 28, self-aligning v-guide 18 on the lower mounting portion 28, mounting hole 20, see-through center hole 22 and a mounting screw 24.

FIG. 1 discloses the rearward end 14 of the new auxiliary sight base bar having an upper sight receiving portion 16 extending the length of the rearward end 14, clamping guide 32 on the upper sight receiving portion 16 on each sides, a see-through center hole 22 having an axis parallel to the longitudinal axis of the elongated base bar and located between the upper sight receiving portion 16 and the lower mounting portion 28.

FIG. 2, shows a self-aligning v-guide 18 on the lower mounting portion 28 and FIG. 1 shows self-aligning v-guide 18 extending inward on the lower mounting portion 28, to a length to match the length of the slot on rifle handle/sight assembly.

FIG. 1 shows a mounting hole 20 on the bottom portion of the lower mounting portion 28.

The manner of using the new sight mount namely are: for mounting combinations of two optical sights, either a combination of a telescope sight and a day/night sight, or a telescope sight and a laser sight; mounting by engaging the lower mounting portion of the new mount to the slot guide standard handle/sight assembly of the rifle. Specifically, the laser and the day/night sights are not a see-through type sights which means that when these sights are used will totally cover the standard front sight of the rifle making the front sight out of use. Using and aiming with a day/night sight requires that both eyes should be opened where the aiming eye sees the red-dot only with a black background and the second eye sees the target where at this point, both the red-dot and the target image are focused jointly in the shooters mind as a single target image with a red-dot on it; for mounting a telescope sight and a laser sight combination on a rifle which permits the laser sight to be mounted also below the telescope and in line and in between the standard front and rear sights of the rifle and when the laser sight is activated, the laser beam will pass through just slightly above the standard front sight of the rifle and projected toward the target. Aiming with a laser sight is preferably used by looking straight towards the target and from a hip or other convenient shooting position without looking through the standard near sight of the rifle and the see-through center of the new mount, shooter will only point the laser beam directly to the target and fire the shots when necessary.

SUMMARY, RAMIFICATION, AND SCOPE

In the present invention, shooter has the option of using the two optical sights alternately and instantly to suit shooting needs.

In general, terms, the new mount provides shooter with several options of mounting the optical sights, namely, by mounting with two optical sights; interchangeability between the day/night sight and the laser sight without altering bullet point of impact or re-sighting; both optical sights installed can be used instantly at any time to suit shooting condition; mounting with a singe optical sight, either a telescope, a day/night or a laser sight; and mounting a single optical sight either on the forward end or rearward end of the auxiliary sight base bar for specific shooting purpose.

The new embodiment, having a rearward end being rigidly attached to the forward end of the elongated base bar such that the upper surface is in line with and parallel to the elongated base bar and also spaced at a distance bellow the see-through center hole of the elongated base bar. Furthermore, the new sight mount has the additional advantages in that, it permits mounting of two optical sights without doubling the height of the optical sights, since the second optical sight is mounted below telescope sight.

it permits the use of either optical sights instantly by moving the users head slightly upward or downward to align aiming eye towards either optical sights, since both optical sights are mounted vertically in line.

it permits maintain the use of fixed bayonet capabilities on assault type firearms, since, the new mount is mounted above the rifle allowing the bayonet lug free from obstruction.

it permits mounting of the day/night sight, such that, the red-dot from the day/night sight is in line with and in between the standard front and rear sights of the rifle which aids natural aiming position needed for achieving faster sight and target acquisition for a more precise hit on the first shot and multiple speed shots.

it permits the use of either optical sights instantly, which allows better penetration of the cross-hairs, red-dot or the laser beam aiming devices from the optical sights to pass though towards the target to whatever target the aiming eye is seeing, specially when shooting prone position with rifle closer to the ground.

it permits mounting an electronic laser sight closer to the trigger finger to allow usage of a short remote cable on-off switch.

it permits the use of a fully automatic rifle, minimizing heat conduction from traveling towards the optical sights with rifle fired continuously to full automatic reaching extreme high heat limit, since the optical sights are separated from the rifle barrel.

it permits mounting of two optical sights that are better protected from being damaged against impact to the ground or hard objects during combat maneuver, since, both optical sights are mounted on top of rifle.

it permits use of wide range of ring mount models, since the clamping guide 12 on the upper surface 30 of the elongated base bar is detachable and replaceable.

Although the descriptions above contains many specifities, these should not be construed as a limiting the scope of the invention, but merely as providing illustrations of the preferred embodiments of this invention. For example, the said clamping guide 12 is replaceable and self-aligning to accept widely used types of ring mount models.

I claim:

1. In a sight mount of the type comprising an elongated base bar having a forward end, a rearward end, an upper sight receiving portion and a lower mounting portion, a clamping guide on the upper sight receiving portion, a see-through center hole having an axis parallel to the longitudinal axis of the elongated base bar and located between the upper sight receiving portion and the lower mounting portion, and a self-aligning v-guide having a mounting hole on the lower mounting portion for mounting the sight on a firearm, the improvement comprising;

an auxiliary sight base bar having an upper surface, a forward end and a rearward end;

the rearward end of the auxiliary sight base bar being rigidly attached to the forward end of the elongated base bar such that the upper surface is in line with and parallel to the elongated base bar and also spaced at a distance below the see-through center hole of the elongated base bar, and the auxiliary sight base bar further comprising a clamping guide on the upper surface thereof.

2. The mount of claim 1, wherein said clamping guide on the upper surface of the auxiliary sight base bar is detachable.

* * * * *